United States Patent [19]

Elsner et al.

[11] Patent Number: 4,594,113

[45] Date of Patent: Jun. 10, 1986

[54] PROCESS FOR PRODUCING REINFORCING STEEL IN THE FORM OF RODS OR ROD WIRE

[75] Inventors: Emil Elsner; Horst Brehmer, both of Gerlafingen, Switzerland

[73] Assignee: Von Roll AG., Gerlafingen, Switzerland

[21] Appl. No.: 738,598

[22] Filed: May 28, 1985

[30] Foreign Application Priority Data

May 30, 1984 [CH] Switzerland ..... 2675/84

[51] Int. Cl.[4] ..... C21D 9/52

[52] U.S. Cl. ..... 148/12 B; 148/12.3

[58] Field of Search ..... 148/12 B, 12.3

[56] References Cited

U.S. PATENT DOCUMENTS 3,900,347 8/1975 Lorenzetti et al. ..... 148/12 B
3,926,687 12/1975 Gondo et al. ..... 148/12 B
3,933,534 1/1976 Ettenreich et al. ..... 148/12 B
4,233,089 11/1980 Lanner ..... 148/12 B

*Primary Examiner*—Wayland Stallard
*Attorney, Agent, or Firm*—Bachman & LaPointe

[57] ABSTRACT

For the production of a reinforcing steel with a higher yield point and good weldability and toughness, microalloying elements are alloyed with the steel and their proportion represents 0.02 and 0.06% vanadium and 0.01 to 0.02% nitrogen, said proportions not being sufficient for achieving a higher yield point of at least 450 N/mm$^2$. However, this is reached if the rolling stock undergoes controlled, but relatively limited cooling during or after rolling, in such a way that the compensating temperature of the steel reaches at least 700° C. Due to the fact that the microalloying elements are only alloyed in small quantities and only relatively small water quantities are required, reinforcing steel can be economically produced. In addition, the process permits coiling in the case of wire rolling and can also be used on other rolled steel products.

15 Claims, 3 Drawing Figures

PROCESS FOR PRODUCING REINFORCING STEEL IN THE FORM OF RODS OR ROD WIRE

BACKGROUND OF THE INVENTION

The present invention relates to a process for producing reinforcing steel in the form of rods or rod wire with a yield point of at least 450 N/mm$^2$, accompanied by good weldability and toughness.

An attempt is made when producing reinforcing steel to obtain higher yield points, whilst retaining good toughness and welding characteristics. In this context, the term good welding characteristics is understood to mean the suitability of such reinforcing steels for the presently conventional welding processes, such as e.g. electric arc hand welding, shielded arc welding, flash butt welding and resistance spot welding. The criterion for the evaluation of the weldability is the carbon content or carbon equivalent, whereby said values must be as low as possible.

The following reinforcing steels with high yield points are known:

1. Naturally hard reinforcing steels.

They achieve their yield point through alloying in the following alloying elements: approximately 0.4% carbon, approx. 1.2% manganese and approximately 0.5% silicon. Due to the high carbon content, these steels are not weldable. 2. Naturally hard reinforcing steels with the addition of microalloyin elements.

Limited weldability is possible in that part of the carbon is replaced e.g. by vanadium, the alloying elements having the following values: carbon approx. 0.3%, manganese approx. 1.2%, silicon approx. 0.5% and vanadium approx. 0.03%.

3. Naturally hard reinforcing steels with increased addition of microalloys and increased nitrogen contents.

Due to the strength-increasing action of the vanadium nitrides which form in an uncontrolled manner, it is possible to further reduce the carbon content, so that the steel is weldable. Such steels are e.g. described in the Union Carbide publication "CARVAN & NITROVAN", vanadium carriers produced by Union Carbide for steel production. They have the following alloying elements: carbon approx. 0.2%, manganese approx. 1.2%, silicon approx. 0.5% and vanadium approx. 0.08%. However, weldability is obtained with higher production costs resulting from the addition of vanadium.

4. Strain-hardened reinforcing steels.

These steels attain their characteristics through strain-hardening, such as e.g. twisting, stretching or drawing. From the carbon equivalent standpoint, they are weldable and have the following alloying elements: carbon equal to or below 0.2%, manganese approx. 0.6% and silicon approx. 0.2%. However, as a result of too much heat being introduced, during welding such steels can lose their strength. In addition, the additional strainhardening stage increases costs.

5. Reinforcing steels heat treated from the rolling heat.

Reinforcing steels are known (e.g. from DE-AS 2,353,034 and East German Pat. 84,615), which achieve their higher yield point, in that they are heat treated from the rolling heat during or immediately following rolling. As a result of an intense quenching in water, hardening of the surface zone of the rod is obtained and following the leaving of the cooling zone, this is retained by the heat in the rod core. Thus, the known temperature profiles are used which, due to the poor thermal conductivity of steel compared with other metals are normally obtained during the cooling or heating processes.

Due to the low carbon equivalent, similar to that of strain-hardened steel (carbon equal to or below 0.2%, manganese approx. 0.6% and silicon approx. 0.2%) such steel can be readily welded.

However, for the purpose of this process, it is necessary to have adequate cooling water quantities and space for the cooling zone in the rolling train. The surface of the rolling stock is cooled to a temperature of less than 200° C. and after running up onto the cooling bed the compensating temperature is approximately 600° C. Due to the low surface temperature, increased demands are made on the hot shear with respect to shearing force and blade quality and the conveying means to the cooling bed are subject to faster wear.

In addition, this cooling process cannot be performed in a satisfactory manner in the case of very high rolling speeds, such as e.g. occur with wire rolling. A further difficulty occurs on coiling, if the surface temperature is below 200° C. and is then only heated up again to approximately 600° C.

In this connection, it is pointed out that the use of reinforcing steel in the form of profiled rod wire in rings, particularly as a raw material for binding plants is constantly increasing.

SUMMARY OF THE INVENTION

The problem of the present invention is to provide a process for producing a reinforcing steel of the aforementioned type with a higher yield point and good toughness and welding characteristics, according to which said reinforcing steel can be less expensively produced as a result of lower microalloying and other alloying element contents, which does not require which water quantities and costs for use in the rolling mill, where the heat shear and cooling bed intake are not excessively stressed and following which the reinforcing steel can be produced simply in the form of profiled rod wire in rings.

According to the invention, this problem is solved in that the steel is microalloyed with nitriding elements and nitrogen and during and/or following rolling is subject to controlled cooling, which leads to an average compensating temperature exceeding 700° C., so that there is a preferred nitride deposition below the gamma-alpha conversion range.

It has been found that in the case of a steel with a low carbon equivalent and with which microalloying elements such as vanadium and nitrogen are only alloyed in small quantities, the deposition process of the vanadium (carbo) nitrides is effectively attained in preferred form if during and/or after rolling, the steel is additionally rapidly cooled by controlled cooling in the temperature range below the gamma-alpha conversion range. In order to be able to produce a reinforcing steel with a yield point higher than 500 N/mm$^2$, the vanadium content in the case of a low carbon equivalent need only be 0.04%. A compensating temperature greater than 700° C. has proved advantageous as the deposition temperature. In the case of this limited cooling, the rolling stock temperature directly on leaving the cooling zone has a temperature greater than 600° C. and, as a result of the limited cooling coating thickness, is very rapidly reheated to a temperature greater than 700° C. As a result, the heat shear and cooling bed intake are protected more in the case of rod rolling than in the production of reinforcing steels heat-treated from the rolling heat and coiling is possible in the case of wire rolling.

BRIEF DESCRIPTION OF THE DRAWINGS

The invention is described in greater detail hereinafter relative to certain operating results and with reference to the drawings, wherein show.

DETAILED DESCRIPTION OF THE INVENTION

Hereinafter, certain operating results are described and are represented in the attached graph.

On three molten baths with the composition 0.16% carbon, 0.2% silicon and 0.65% manganese and the standard companion elements of an electric steel, as well as vanadium and nitrogen contents of

VO.01%, N 0.010%
VO.04%, N 0.012%
VO.06%, N 0.012% the results given in the graph were obtained on reinforcing steels with small diameters (8 to 12mm).

Figure 1:
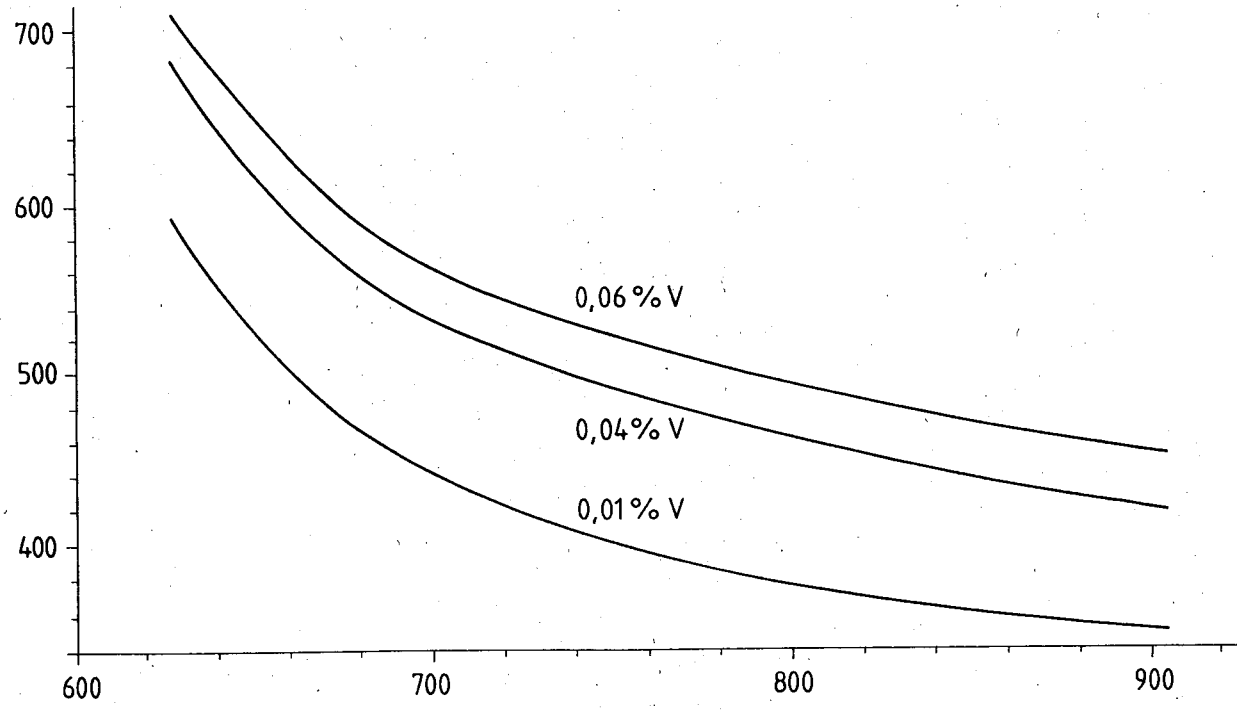
FIG. 1 a graph showing the relationship between the yield point and the compensating temperature of reinforcing steel and various microalloying element proportions.
Figure 2:
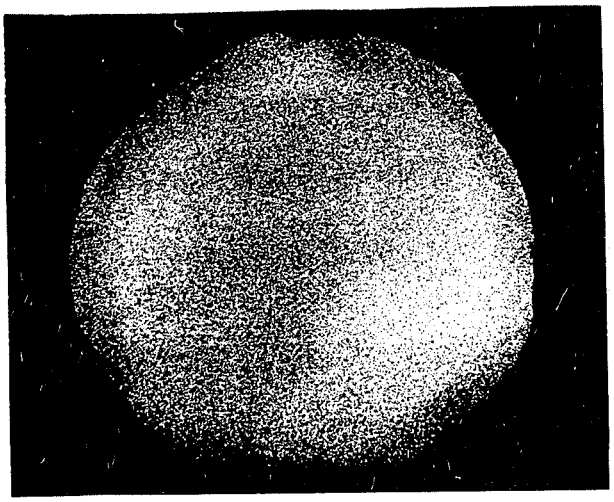
FIG. 2 the micrograph of a reinforcing steel produced according to the invention with a diameter of 8mm, a V content of 0.04% and a compensating temperature of 710° C.
Figure 3:
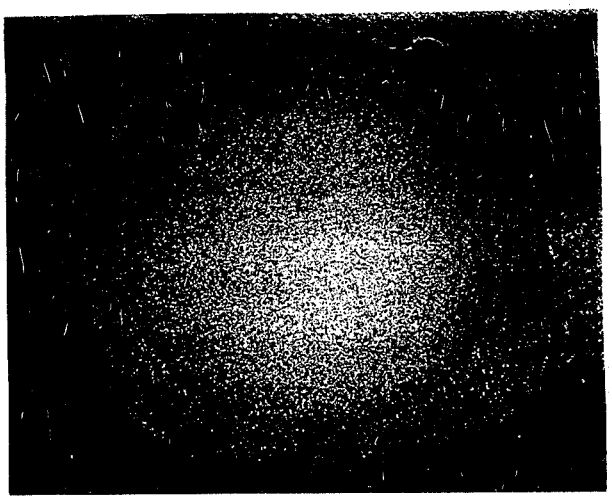
FIG. 3 the micrograph of the same reinforcing steel but in which, through an intense quenching by water, surface hardening is obtained for a compensating temperature of 655° C.

Whereas without controlled cooling (compensating temperature approx. 900° C.) yield points of 350, 420 and 450 N/mm$^2$ were reached, in the case of controlled cooling the values increase and at a compensating temperature of 700° C. are 440, 530 and 560 N/mm$^2$ (FIG. 1). In the case of compensating temperatures below 700° C., hardening effects are noticed (FIG. 3). However, these temperatures would be too low for the purposes of the invention.

On another molten bath with the composition 0.21% carbon, 0.25% silicon and 0.73% manganese and the standard companion elements, as well as 0.04% Vanadium and 0.011% Nitrogen for a reinforcing steel with a diameter of 13 mm having a compensating temperature of 715° C., a yield point of 540 N/mm$^2$ was reached.

According to the invention, the upper compensating temperature is defined by the gamma - alpha conversion temperature ($A_{r3}$ point). The latter is dependent on the austenitizing temperature and particularly the steel composition and in the indicated example is approximately 825° C.

After rolling, the gamma - alpha conversion should take place as quickly as possible in the core. It is therefore appropriate to control the cooling in such a way that on the one hand the gamma - alpha conversion in the core is further accelerated and on the other hand so that the rod surface temperature does not drop below the $M_S$ point, which is 450° C. in the example. Compensating temperatures up to 760° C. have been found as appropriate.

As a criterion for the controlled cooling, the average heat flux density was determined, which with rod diameters of 8 to 12 mm was approximately 11 MW/m$^2$ and with a rod diameter of 20 mm approximately 6 MW/m$^2$.

The average heat flux density was understood to mean the heat quantity removed by the cooling medium, related to the rod surface cooled during the cooling time in the cooling plant.

The test results make it clear that, despite the low carbon equivalent and low content of microalloying elements (vanadium and nitrogen) in the case of controlled cooling, the required high yield points of reinforcing steel of equal to or greater than 500 N/mm$^2$ can be easily and inexpensively set.

A vanadium content of 0.04% in the case of a nitrogen content of 0.012% (120 ppm) is sufficient to increase the vanadium content to 0.06% only has a comparatively limited effect.

Obviously, the process can also be used on products and/or steel types other than reinforcing steel in rod or wire rod form, e.g. on steel bars and flat products.

What is claimed is:

1. A process for producing reinforcing steel characterized by a yield point of at least 450 N/mm$^2$ in combination with good weldability and toughness, which comprises:

(a) providing a steel alloy comprising nitriding elements and nitrogen;

(b) rolling said steel alloy; and (c) cooling said steel alloy at an average compensating temperature of greater than 700° C. such that there is a preferred nitride deposition below the gamma-alpha conversion range.

2. A process according to claim 1 wherein said steel alloy is cooled during rolling.

3. A process according to claim 1 wherein said steel alloy is cooled after rolling.

4. A process according to claim 1 wherein said nitriding element is vanadium.

5. A process according to claim 4 wherein said vanadium is present in an amount of about 0.02 to 0.06 wt.%.

6. A process according to claim 5 wherein said vanadium is present in an amount of about 0.03 to 0.05 wt.%.

7. A process according to claim 1 wherein carbon is present in an amount of about 0.01 to 0.02 wt.%

8. A process according to claim 4 wherein carbon is present in an amount of about 0.01 to 0.02 wt.%.

9. A process according to claim 1 wherein nitrogen is present in an amount of about 0.01 to 0.02%

10. A process according to claim 4 wherein nitrogen is present in an amount of about 0.01 to 0.02%

11. A process according to claim 5 wherein nitrogen is present in an amount of about 0.01 to 0.02%

12. A process according to claim 11 wherein manganese is present in an amount of about at least 0.6 wt.%.

13. A process according to claim 1 wherein said steel alloy is wire wherein the heat flux density on cooling of the rolled stock is about 11 MW/m$^2$ for an 8 mm diameter wire and about 6 MW/m$^2$ for a 20 mm diameter.

14. A process according to claim 13 wherein said wire is coiled at a temperature of greater than 700° C.

15. A process according to claim 1 wherein said rolled steel alloy is heat-sheared at a temperature greater than 700° C.

* * * * *